US008308088B2

(12) United States Patent
Comer

(10) Patent No.: US 8,308,088 B2
(45) Date of Patent: Nov. 13, 2012

(54) PULVERISER MILL

(75) Inventor: Paul Andrew Comer, Stafford (GB)

(73) Assignee: William Graham Bell (GB)

( * ) Notice: Subject to any disclaimer, the term of this patent is extended or adjusted under 35 U.S.C. 154(b) by 0 days.

(21) Appl. No.: 13/403,301

(22) Filed: Feb. 23, 2012

(65) Prior Publication Data

US 2012/0153061 A1 Jun. 21, 2012

Related U.S. Application Data

(63) Continuation of application No. 12/664,190, filed as application No. PCT/GB2009/050030 on Jan. 16, 2009, now Pat. No. 8,141,800.

(30) Foreign Application Priority Data

Mar. 20, 2008 (GB) ..... 0805207.8

(51) Int. Cl.
*B02C 15/00* (2006.01)

(52) U.S. Cl. ..... 241/19; 241/119

(58) Field of Classification Search ..... 241/19, 241/107, 117–121
See application file for complete search history.

(56) References Cited

U.S. PATENT DOCUMENTS 8,141,800 B2 * 3/2012 Comer ..... 241/19

FOREIGN PATENT DOCUMENTS

EP 0507983 * 7/1991
JP 03284360 * 12/1991

* cited by examiner

*Primary Examiner* — Mark Rosenbaum
(74) *Attorney, Agent, or Firm* — Shumaker, Loop & Kendrick LLP

(57) ABSTRACT

A pulveriser mill having a rotatable grinding ring and a rotatable port ring around the circumference of the grinding ring co-rotatable therewith, the port ring defining around its 360 degree extent a plurality of openings separated by lands, the openings permitting air to flow from beneath the grinding ring to above the grinding ring, and the lands serving as obstructions to the flow of air from beneath the grinding ring to above the grinding ring, wherein the aspect ratio of the openings is in the range from 1:1 to 3:1.

16 Claims, 7 Drawing Sheets

PULVERISER MILL

CROSS-REFERENCE TO RELATED APPLICATIONS

This application is a continuation application claiming priority to U.S. application Ser. No. 12/664,190 filed Dec. 11, 2009, which is a U.S. National Stage Application of PCT/GB09/50030 filed Jan. 16, 2009, which claims priority to GB Application No. 0805207.8 filed Mar. 20, 2008, the contents of each of which are incorporated by reference herein.

TECHNICAL FIELD AND BACKGROUND OF THE INVENTION

This invention relates to industrial apparatus, namely a pulveriser or grinding mill, in which pieces of a material are pulverised into a finer particulate form. The invention relates particularly, but not exclusively, to a mill in which coal is pulverised into a powder form which is conveyed to combustion apparatus e.g. of a power station.

In particular the invention concerns a mill having a lower grinding ring, which may be a part formed with an annular depression. Grinding elements are sandwiched between the lower grinding ring and a top member, which may have an annular depression facing an annular depression in the grinding ring. The grinding ring and the top member are moveable relative to one another. The grinding ring and the top member are typically ring-shaped; the terms "grinding ring" and "top ring" may hereinafter be used.

Typically the required relative movement between the grinding elements and the lower grinding ring is achieved by driving the grinding ring, while the top ring is held against rotation. The grinding elements, which are typically steel balls or rollers, are not driven. They may be fixed in position, or free to precess.

The mill with which the invention is concerned is of the type having a rotating port ring generally as described in EP 0507983A. Such a port ring is provided, between the periphery or circumference of the grinding ring and an inclined liner (which may also be called a skirt, or gusset) carried by the wall of the mill. There is provided an annular passage or "throat", just outboard of the grinding ring. Air flows upwardly through the port ring. The port ring has inner and outer annular walls, between which there area plurality of spaced-apart, inclined, vanes, separating openings through which air can flow. The port ring rotates with the grinding ring and the vanes impart a desired vector to the generally upwards air flow.

Around its 360 degree extent the port ring may define only openings and the through-thicknesses of the vanes. That is to say there is in effect an annular passage separated into individual openings only by the through-thicknesses of the vanes.

The inner and outer annular walls of the port ring are fixed. The gap between them, in which the vanes are located, cannot be varied.

The size of the gap is selected to provide an optimal air flow rate, which assures efficient advancement of coal fines towards the combustion apparatus. Control of air flow rate is of critical importance in a mill. Too high an air flow rate for a given throughput gives an increased risk that non-combustible materials may be carried forward to the combustion apparatus, along with desired coal fines. Too low an air flow rate, and the coal fines are not all carried to the combustion apparatus, leading to inefficient operation.

The rotating port ring is an excellent and successful mill feature but it is not optimal with coal sources which give rise to incomplete grinding; especially with coal sources which contain inclusions of rock. In such circumstances some unground pieces may be too big to fall through the port ring, and back into the material to be fed to the grinding zone, or scrapped.

SUMMARY OF THE INVENTION

In accordance with a first aspect of the present invention there is provided a pulveriser mill having a rotatable grinding ring, and a rotatable port ring around the circumference of the grinding ring, wherein the port ring defines, around its 360 degree extent, a plurality of openings which are separated by lands, the openings permitting air to flow from beneath the grinding ring to above the grinding ring and the lands serving as obstructions to the flow of air from beneath the grinding ring to above the grinding ring, wherein the aspect ratio of the openings (length divided by radial width) is in the range from 1:1 to 3:1.

Preferably the openings are wide. In the present invention the openings being "wide" means that the openings present a larger gap, in the radial direction, than would be found in a corresponding prior mill not having lands. To consider this, the summated area A of the openings $A^1$ in the mill of the present invention, separated by lands, may be compared with the summated area B of openings $B^1$ of a notional port ring of the same diameter, separated instead only by the through-thicknesses of vanes, in a mill which is in all other respects the same as said mill of the present invention. The ratio of A to B is preferably in the range 0.7 to 1.3, preferably 0.9 to 1.1. In other words the summated area is the same or similar. Given the presence of the lands, the openings $A^1$ must be wider than the openings $B^1$, for the summated area A to be the same or similar to the summated area B. Preferably the mean width of the openings $A^1$ is from 1.1 to 3 times the mean width of the openings $B^1$, preferable from 1.5 to 2.5 times the mean width of the openings $B^1$. The total area available for air flow is thereby similar.

Preferably there is present a mill liner outside the port ring, suitably carried on the inside wall of the mill, as an annulus. The liner is typically a downwardly slanted metal skirt or gusset.

Preferably the port ring is made wider than heretofore by decreasing the width of, or eliminating, the mill liner.

Preferably the lands in total occupy at least 90 degrees of the 360 degree extent of the port ring, preferably at least 120 degrees, preferably at least 180 degrees, most preferably at least 220 degrees.

Preferably the lands in total occupy up to 280 degrees of the 360 degree extent of the port ring, preferably up to 260 degrees.

Preferably the openings in total occupy up to 270 degrees of the 360 degree extent of the port ring, preferably up to 240 degrees, preferably up to 180 degrees, and most preferably up to 140 degrees.

Preferably the openings in total occupy at least 80 degrees of the 360 degree extent of the port ring, and preferably at least 100 degrees.

The aspect ratio of the openings may be defined herein as the (mean) length divided by the (mean) width in the radial direction. Preferably the aspect ratio is in the range from 1:1 up to 2.5:1, most preferably from 1.2:1 up to 2.1:1.

Suitably the openings are generally rectangular (in which case the "length" is the straight length of the opening; orthogonal to the radial width), or are arcuate, preferably following the curvature of the circumference of the port ring (in which case the "length" is measured along the "hoop direction" thereof).

All measurements and definitions based thereon given in this specification are made with reference to the horizontal plane and/or as viewed from above in plan view.

Preferably the port ring is co-rotatable with the grinding ring. Preferably it is secured to the grinding ring for rotation therewith and includes a plurality of spaced-apart vanes. The vanes have upper and lower ends, and are preferably oriented at an angle in the range of 20 degrees to 40 degrees relative to a vertical axis of the mill, in a manner such that the lower ends lead, in the direction of rotation of the grinding ring, and the upper ends trail. Preferably adjacent vanes are spanned by respective lands or are left open. Preferably the openings and lands alternate, around the port ring.

There is typically a running clearance outside the port ring and this is a further opening available for air flow. In one embodiment the area available for air flow is the summation of the port ring openings and the running clearance; there are no further openings. When there is a mill liner the running clearance is suitably between the mill liner and the port ring.

The prior port ring of EP 507983A exhibits significant advantages over earlier pulveriser mill designs. Most importantly, it provides for air flow upwardly through the port ring in a manner such that the air flow is essentially vertical (as opposed to predominantly spinning or swirling movement obtained with some other apparatus). With such apparatus the air flow provides excellent upward transport of pulverised material (e.g., coal dust) with minimum required air velocity, and with low tendency to lift large particles.

However it is a limitation that unground pieces of a certain size are not able to fall through the port ring. Rather they may rest on the port ring and block the flow of air.

The provision of wider openings, but with lands between them, thereby to keep the overall air flow area, and a mess flow rate similar, reduces this problem without compromising mill operation. In fact, to our surprise, we have found that the measures of the present invention appear to lead to a general improvement in mill performance, going beyond the improvement in dealing with unground pieces. We have no explanation for this other than suggesting (without being bound by theory) that the "injection" of distinct or isolated streams of air produces a more effective air flow pattern above the port ring.

The openings defined herein may be spanned by one or more members, for example cross-bars, and in such cases for the purposes of the definitions herein (e.g. angular extent, width, area, aspect ratio) the length of an opening is regarded as the summation of the (mean) span of the visible or unoccluded portions of the opening in the lengthwise direction and the width of an opening is regarded as the summation of the (mean) span of the visible or unoccluded portions of the opening in the widthwise direction; in each case when viewed from above in plan. Preferably, however, the openings do not have any such members. Preferably they are entirely unoccluded.

Preferably the openings in the port ring are fixed. However the provision of the variable openings in the port ring is not excluded. If the openings in the port ring were variable (for example to change their length) the embodiment is to be regarded as being in accordance with the invention if there is one working configuration in which a definition of the present invention is satisfied. The fact that there may be other configurations in which definitions of the invention are not satisfied is not material.

In accordance with a second aspect of the present invention there is provided a pulveriser mill having a rotatable grinding ring, and a rotatable port ring around the circumference of the grinding ring, wherein the port ring defines, around its 360 degree extent, a plurality of openings which are separated by lands, the openings permitting air to flow from beneath the grinding ring to above the grinding ring and the lands serving as obstructions to the flow of air from beneath the grinding ring to above the grinding ring, wherein the lands occupy from 90 degrees to 280 degrees of the 360 degree extent of the port ring.

In this second aspect the aspect ratio of the openings may be as defined above in the first aspect.

Preferred features of the second aspect are the preferred features of the first aspect, as stated above.

In one embodiment additional, variable, openings are provided; that is, additional to the openings in the port ring (whether themselves variable or, as is preferred, fixed).

Preferably each variable opening is closable. Preferably each variable opening has a fully open condition and a fully closed condition. Preferably each variable opening has at least one condition in between, and preferably a plurality, more preferably a continuum, of conditions in between.

Preferably each variable opening is associated with a closure or blanking part which may be moved so as to change the condition of the variable opening. Preferably each closure part is slid over or under its opening, to change the effective area of the opening. Preferably the variable openings are provided in an annular part which is U-shaped in cross-section, and the closure part is an annular part which is U-shaped in cross-section, nested against (preferably nested beneath), and supported in rotation by, the annular part containing the variable openings. There may be one such closure part or more than one, defining segments of the periphery of the grinding ring.

The or each closure part may be controlled from outside the mill. Suitably this may be done as a pulveriser operation is under way. The or each closure part may be moved by means of a control member, for example a lever, push-pull member, worm and wheel, or rack and pinion gear, the rack being connected to the closure part and the pinion being connected to a control member, for example a control wheel or handle, or control wheels or handles, on the outside of the mill.

The movement of the closure part(s) could be powered by mechanical, electrical, pneumatic or hydraulic means.

Preferably a plurality of variable openings is under the control of a common control member.

Preferably each variable opening is provided on a wider radius than the openings in the port ring. Preferably there is present a mill liner outside the openings in the port ring, and the or each variable opening is provided in the mill liner. As mentioned above the mill liner is typically a downwardly slanted metal annulus carried on the inside wall of the mill.

Preferably each variable opening is rectangular, or is arcuate, and follows the curvature of the mill.

Preferably the variable openings are in an array in the hoop direction; each opening preferably being an arc of a circle, centered on the axis of the mill.

Preferably adjacent variable openings are separated in the hoop direction by a land at least as long as the openings; preferably at least 1.1 times as long; and preferably up to 2 times as long. Thus the variable openings preferably occupy less than 180 degrees of the extent of the 360 degree extent of the mill; and preferably occupy 60 to 160 degrees thereof.

The variable openings can be arranged evenly around the 360 degree extent of the mill, or can be arranged in groups. For example they may be arranged in three groups, the groups being separated by long lands. With certain mills, which have fixed grinding rings, it is not necessary to provide variable openings in the region of the grinding rings; only in the regions between the grinding rings.

Preferably the area of the variable openings, when fully open, is at least 10% of the area of the port ring openings (with the latter fully open, when they themselves are variable); preferably at least 20%, preferably at least 30% and most preferably at least 40%.

Preferably the area of the variable openings, when fully open, is up to 200% of the area of the port ring openings (with the latter fully open, when they themselves are variable), preferably up to 100%, more preferably up to 75%, most preferably up to 60%.

Thus, preferably when variable openings are present they provide, when fully open, from 40 to 60% of the area of the openings in the port ring (with the latter fully open, when they themselves are variable).

The openings in the port ring preferably together provide the major air flow area in the present invention. Additionally there is air flow through the running clearance. The variable openings, when present, are suitably intended for "trimming" the performance.

The provision of variable openings, when present, does not mean that the openings in the port ring must be made narrower.

Reduction in area of the port ring openings may be desirable but can be achieved by employing a design of port ring with somewhat longer lands, and corresponding shorter openings; and/or by reducing the running clearance.

It is a limitation of the existing mill designs described herein that when there is a need to change coal throughput, air speed must be changed in order to maintain the correct air-coal ratio, and hence the optimal velocity in the mill. When the air velocity is simply increased, as may happen in existing mills, there is an increased tendency to lift large pieces of mineral, and to advance them to the combustion apparatus. On the other hand when the air velocity is too low there is an adverse effect on the coal particle size distribution in the ground material advanced to the combustion apparatus, and consequently poor combustion. The provision of variable openings as a preferred aspect of the present invention substantially improves mill operation by permitting air velocity to be held within suitable limits, even when there are large changes in throughput.

The variable openings may be adjusted to vary the air flow rate (i.e. to allow more, or less, air to flow in a given time), but still at a desired air speed.

Operating the mill with the variable opening(s) partly open or open to the maximum extent reduces the requirement to increase the air speed.

Preferably the air speed is kept substantially constant (e.g. ±20% of the mid-value, preferably ±10%) during the method.

In accordance with a third aspect of the present invention there is provided a method of improving an existing pulveriser mill which has a rotatable port ring located around the circumference of a rotatable grinding ring of the mill (the port ring preferably being mounted on the grinding ring for common rotation therewith), the port ring having a plurality of spaced-apart vanes having upper and lower ends, defining openings separated by the through-thickness of the vanes, and the mill having a mill liner mounted to the wall of the mill around the port ring; wherein the method comprises: the replacement of said port ring by a second port ring having wider openings, said wider openings being separated by lands; and the narrowing of the mill liner, or the replacement of the mill liner by a narrower mill liner, or the removal of the mill liner without replacement.

Preferred features of the third aspect are any of the features defined as being necessary or desirable features of the first or second aspects.

In accordance with a fourth aspect of the present invention there is provided a method of operating a mill of the present invention as defined above.

BRIEF DESCRIPTION OF THE FIGURES

The invention will now be further described, by way of example, with reference to the accompanying drawings, in which.

DETAILED DESCRIPTION OF THE INVENTION

Figure 1:
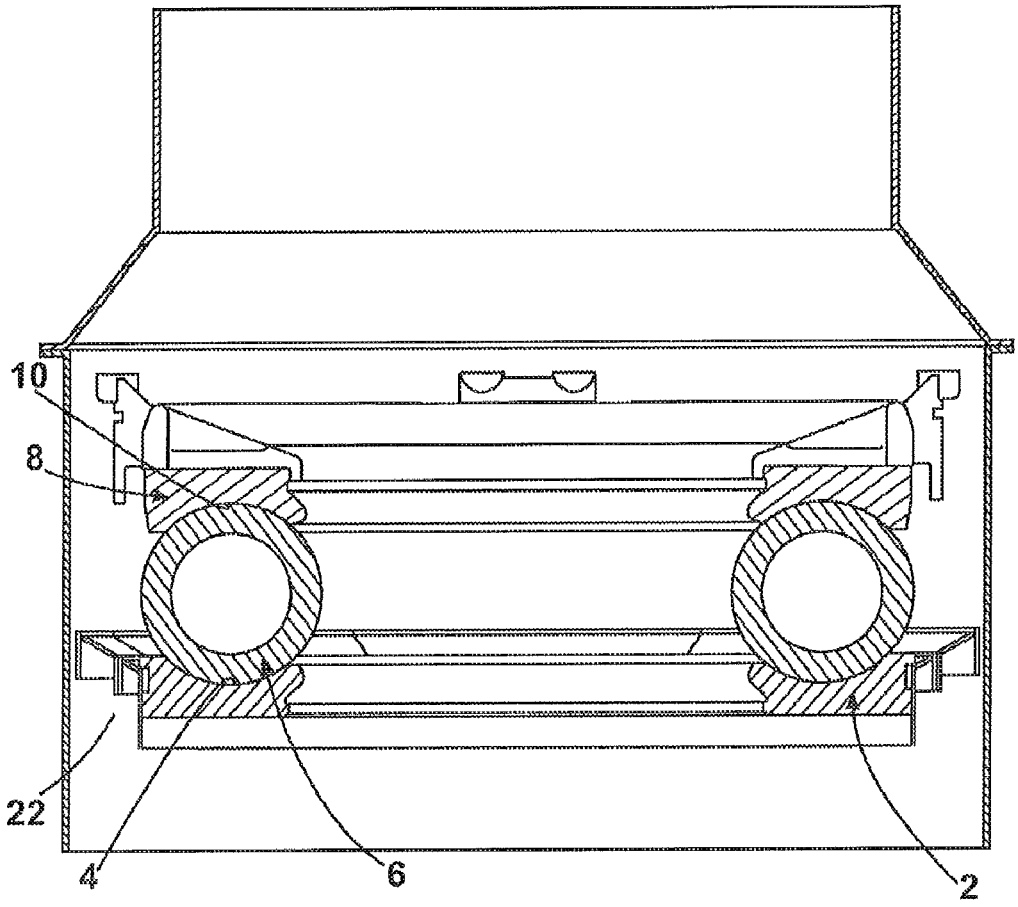
FIG. 1 is a schematic side sectional view of the grinding part of a known pulveriser mill, in operational condition.

FIGS. 1-4 show a prior pulveriser mill generally in accordance with EP 507983A. The mill has a driven, lower steel grinding ring 2 (which is alternatively called a grinding member, or a grinding wheel, in this art). Grinding ring 2 has an upwardly-facing annular groove 4, in which a plurality of grinding elements 6, e.g. steel rollers or balls, are located. Above the grinding elements is located a fixed (non-rotating) steel top ring 8, which has a downwardly-facing annular groove 10, aligned with the annular groove 4 of the grinding ring 2. Therefore the arrangement is like a ball race, with the grinding elements 6 free to precess within the oppositely-directed grooves 4, 10.

This type of pulveriser mill is used in a highly demanding environment, to crush coal into fines (powder) to be combusted. The coal fines are carried upwardly by an air current, towards the combustion apparatus.

Figure 2:
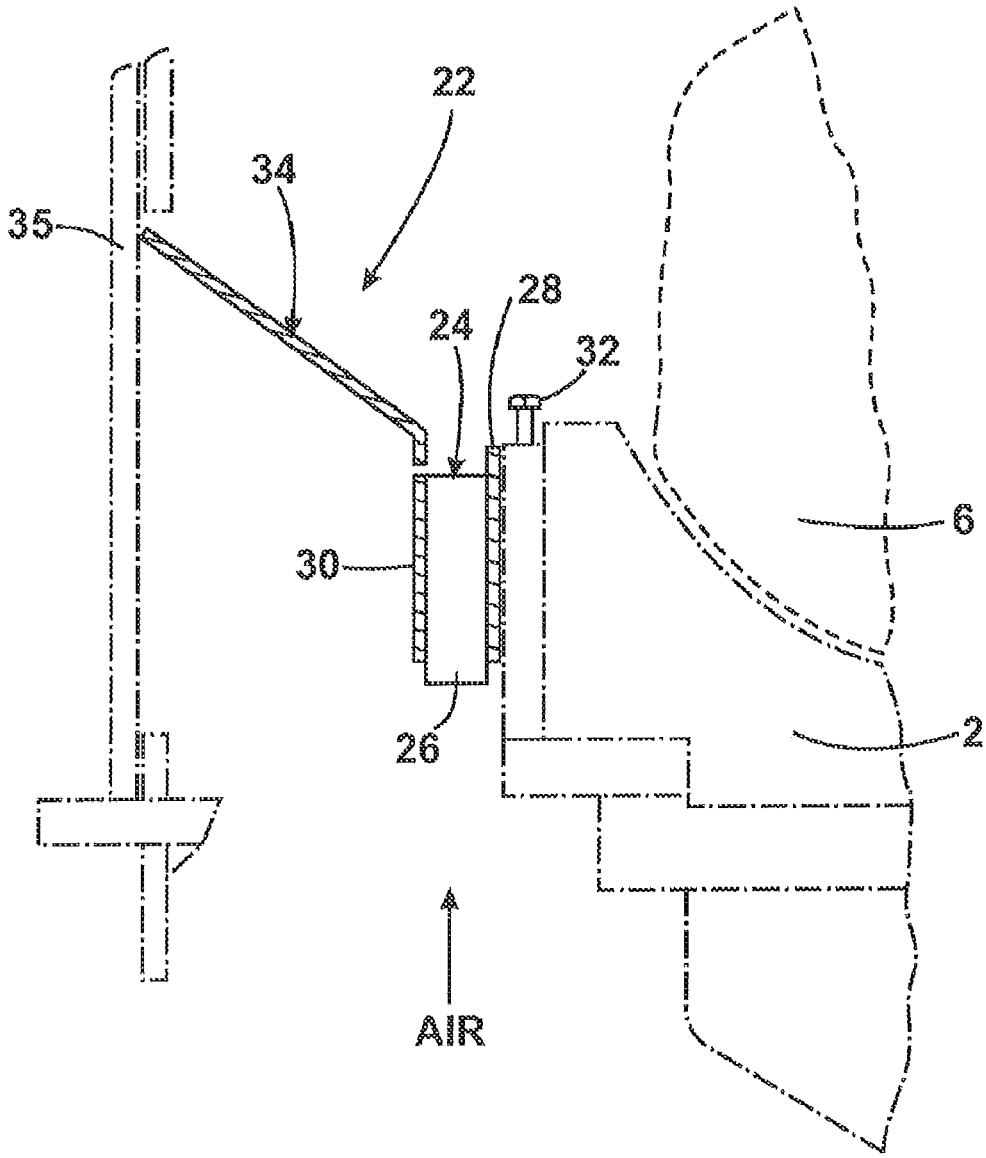
FIG. 2 is a schematic expanded side sectional view of a side region of a similar known pulveriser mill.

Around the grinding ring 2 is a narrow throat 22 and in the throat 22 there is provided a port ring 24 (FIG. 2). This rotates as one with the grinding ring 2, to impart a desired movement to the upwardly-directed air, which carries the coal fines to the combustion apparatus.

Figure 3:
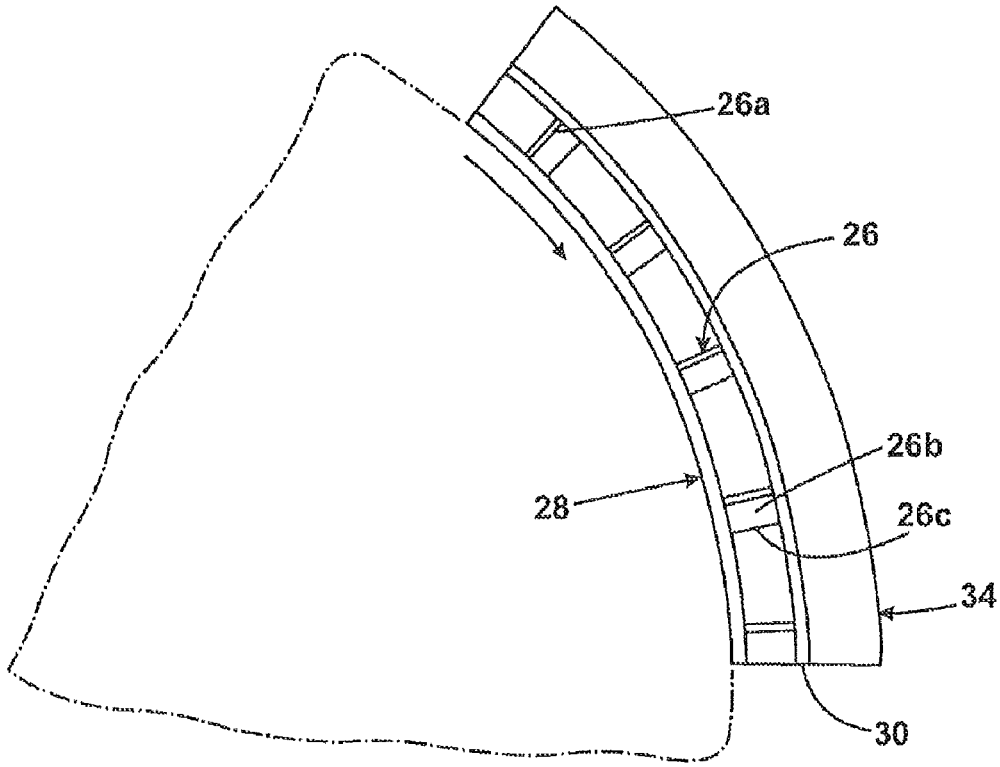
FIG. 3 is a plan view from above of the region shown in FIG. 2.
Figure 4:
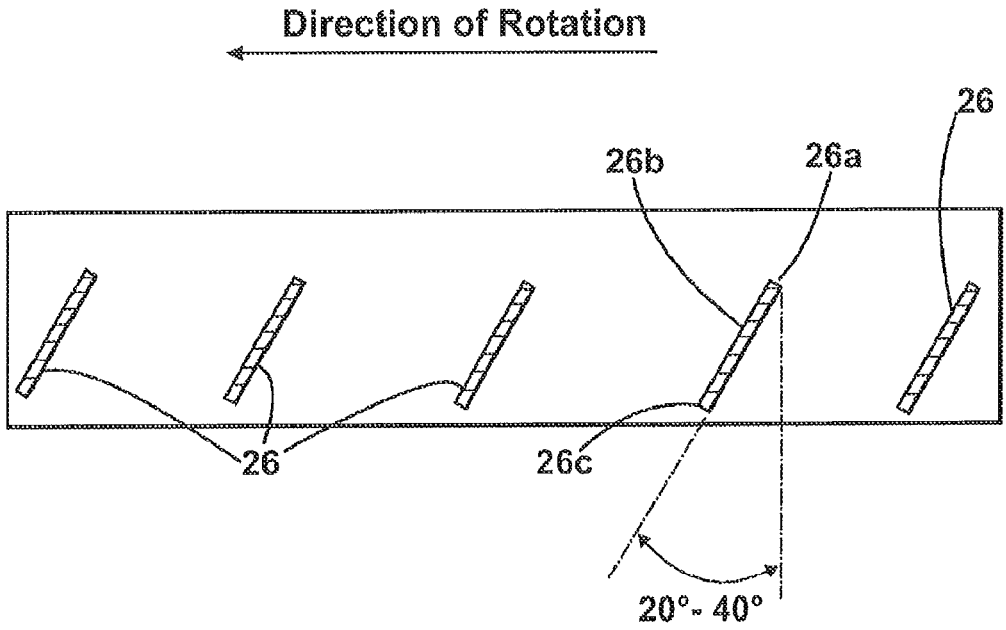
FIG. 4 is a schematic drawing showing the arrangement of vanes and openings, in the region shown in FIGS. 2 and 3.

The port ring 24 comprises a plurality of spaced-apart vanes 26. The vanes 26 are welded between spaced-apart support rings 28 and 30 which are inner and outer circumferential walls of the port ring. Preferably the inner and outer support rings 28, 30 of the port ring 24 are short sections of vertical concentric cylinders. The vanes 26 are inclined. The angle of inclination of the vanes is in the range of 20 degrees to 40 degrees from vertical. Preferably the angle of inclination is 25-30 degrees. The upper ends of the vanes are tilted in a direction opposite to the direction of normal rotation of the grinding ring (that is to say, the tilt of the vanes is such that the upper ends trail the lower ends when the grinding ring is rotated). In FIG. 3 the top edge of a vane is indicated as 26*a*; 26*b* denotes the projection of the inclined frontal face of a vane, visible from, above due to the inclination of the vane; and the lower edge of a vane is indicated as 26*c*. Inner support ring 28 may be secured to the periphery of the grinding ring by means of bolts 32 or by welding, for example.

An annular mill liner 34 extends downwardly from the inside wall 35 of the mill body, to which it is preferably secured, towards the upper and outer edge of the port ring. Then the mill liner extends vertically downwardly to within about 1 cm of the upper edge of the outer member 30 of the port ring. The angle of inclination of the mill liner is typically between 30 degrees and 60 degrees, to the wall of the mill body (i.e. to the vertical).

Particles produced by the crushing or pulverising process are carried upwardly by means of air passing through the port ring 22. Air flows upwardly in a nearly vertical manner with minimal swirling or spinning. As a result, the crushed particles are lifted upwardly in a smooth and efficient manner.

Figure 5:
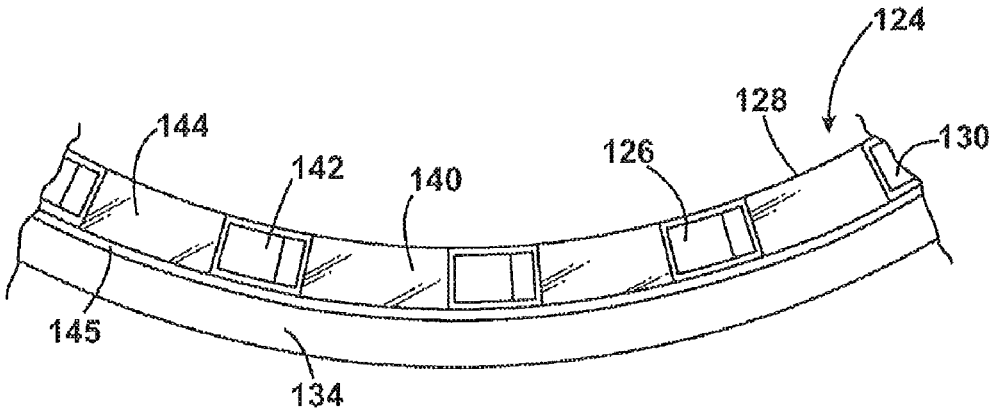
FIG. 5 is a plan view from above of a peripheral region of a mill, illustrating the invention.
Figure 6:
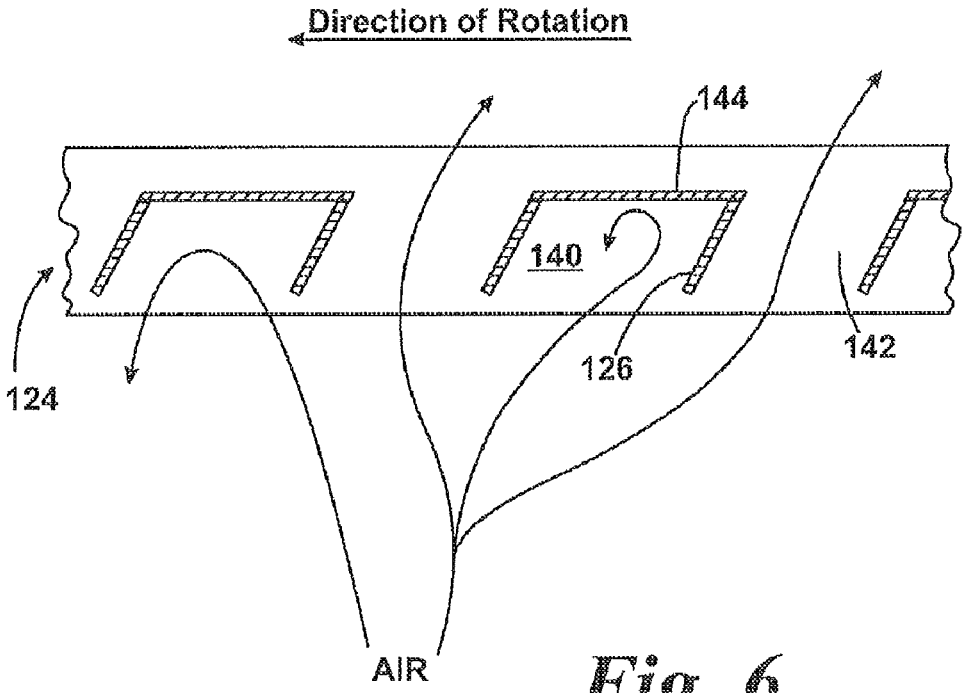
FIG. 6 is a side sectional view of a region of the mill also shown in FIG. 5, showing the arrangement of lands and openings, illustrating the invention.
Figure 7:
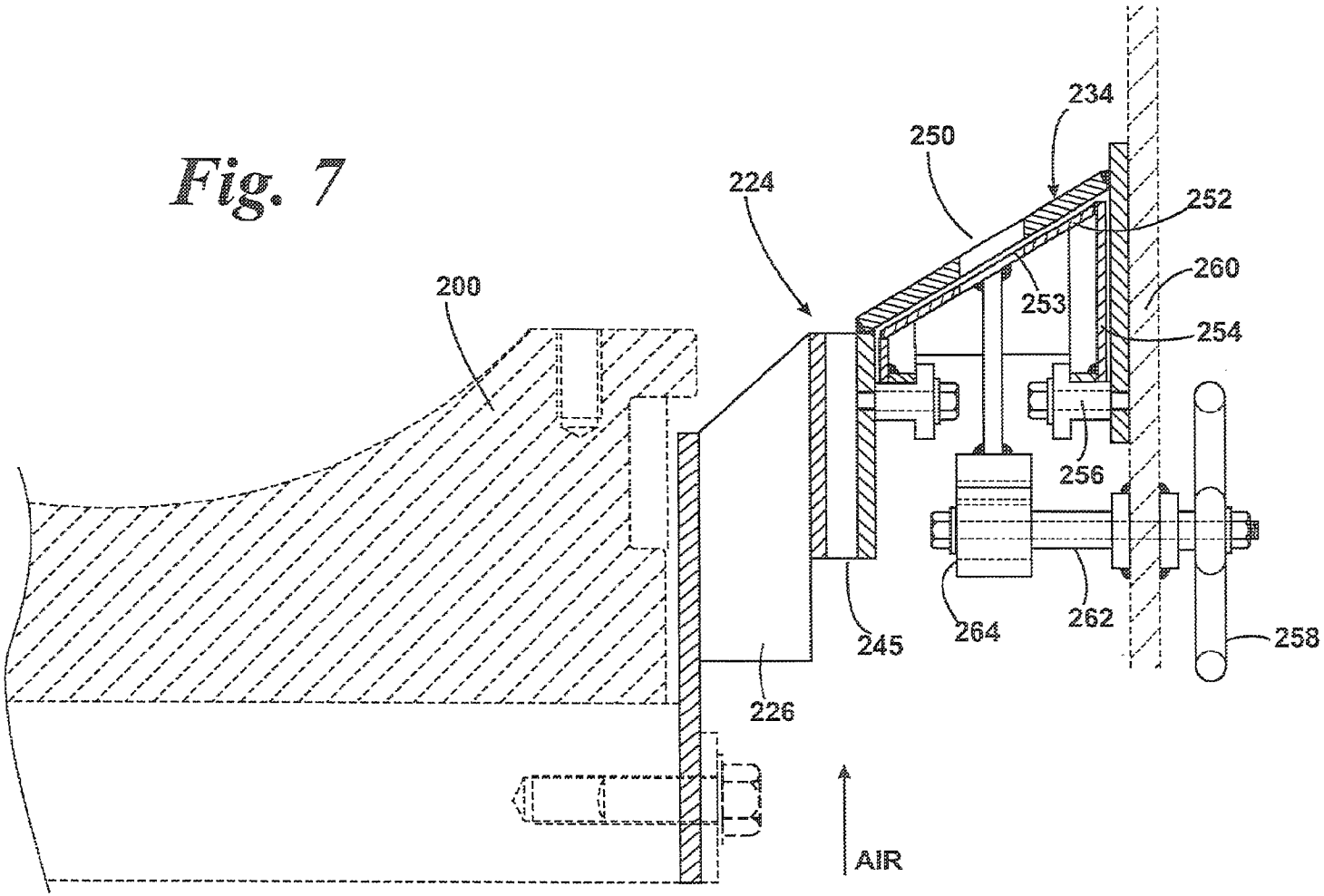
FIG. 7 is a side section view of an edge region of a mill, illustrating the invention, in a second embodiment.

The invention will now be described, by way of example, with reference to the first embodiment of the invention, illustrated in FIGS. 5 and 6.

The overall arrangement is similar to that described with reference to FIGS. 1-4, in its grinding apparatus, and in that a rotating port ring is provided. Like the port ring described with reference to FIGS. 1-4, the port ring 124 has a series of vanes 126, mounted to the grinding ring (not shown) at its circumference. The vanes are mounted and inclined as described above, except that they are not evenly spaced. Each vane is welded in place such that the space 140 to one side of it is longer, in the hoop direction, than the space 142 on the other side of it. The longer spaces 140 are blanked off by blanking plates or lands 144, welded to the upper edges of the respective vanes 126, and to the upper edges of the support rings 128 and 130, over the spaces 140. Thus, only the other spaces 142, forming fixed openings or ports, and defined by the more closely spaced vanes, are available for the through-flow of air. In this embodiment the ratio of the lengths of these spaces in the hoop direction (space 140 to space 142) is approximately 1.5 to 1. It will be apparent that more than one-half (in fact, about 215 degrees) of the annular extent of the port ring 124 has been rendered unavailable for air flow—see FIG. 6 (about 145 degrees of the annular extent therefore being available for air flow).

A running clearance 145 is provided between the port ring 124 and the mill liner 134. The running clearance and the openings 142 together constitute the whole of the area available for air flow.

It is highly desirable to keep air speed at an optimum level and, at least approximately, to maintain the available area for the throughput of air. To achieve this the port ring 124 is made wider than has heretofore been the case—for example wider than the port ring shown in FIGS. 1 to 4. The port ring, and in particular the openings in the port ring, are approximately 2.5 times as wide as they would have been, had the lands not been used, in this embodiment.

The result is a port ring which no longer provides a narrow throat obtruded only by the through-thicknesses of the vanes; it is a port ring which is considerably wider than it would otherwise have been, but with alternate openings covered by lands 144. The summated area thereby provided for flow-through of air is thus similar, for the mill of the present invention and the prior mill having a narrower port ring without lands. This means that large pieces of unground spoil, such as rock, can fall through the port ring of FIGS. 5 and 6, and back into material to be fed into the grinding zone, or into scrap, instead of accumulating on the port ring, as would have happened before.

The widening of the port ring may be accommodated by the mill liner 134. When an existing mill, having a mill liner, is modified, the mill liner may be narrowed in-situ by removing a portion thereof in the mill; or the original mill liner may be removed and a narrower mill liner fitted in its place; or, in some cases, the mill liner may simply be removed, without being replaced. When a port ring/mill liner assembly is being fitted for the first time (either to an existing mill without a mill liner or as part of a newly constructed mill), a wide port ring and a narrow liner may be used (relative to the port ring and liner which would previously have been used).

The invention will now be described, by way of example, with reference to the second embodiment shown in FIGS. 7 and 8A-8C.

The overall arrangement is similar to that described with reference to FIGS. 1-4, in its grinding apparatus, and in that a rotating port ring is provided. Like the port ring described with reference to FIGS. 5 and 6, the port ring 224 is mounted to the grinding ring 200 at its circumference, and has a series of fixed openings 240, each pair of adjacent openings being separated by a land 244, with each land spanning a pair of vanes 226 and completely closing what would otherwise have been further openings. A running clearance 245 is shown between the port ring 224 and the inclined mill liner 234. The running clearance and the fixed openings together constitute the fixed area available for air flow. However it will be seen that in this embodiment the mill liner 234 is no longer a plain non-apertured annular sheet but has a series of spaced-apart, additional openings 250, arranged in an annular array. Each opening is an elongate rectangle (but in another embodiment could be an arc, with the arcs being in a circular array, following the shape of the mill liner 234.

Figure 8A:
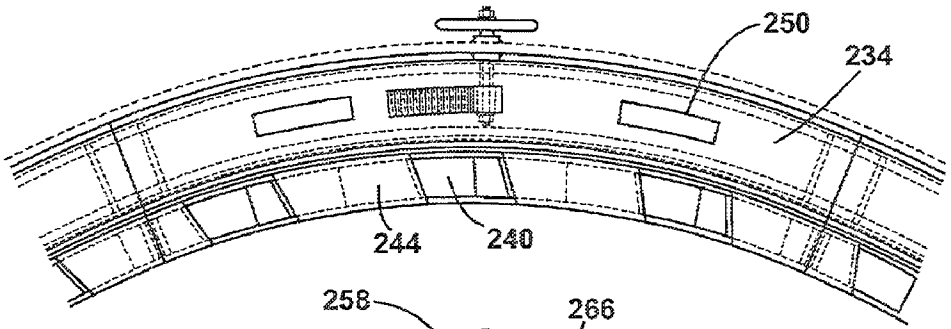
FIGS. 8A-8C are plan views, showing the side region of the second embodiment in different stages of operation.
Figure 8B:
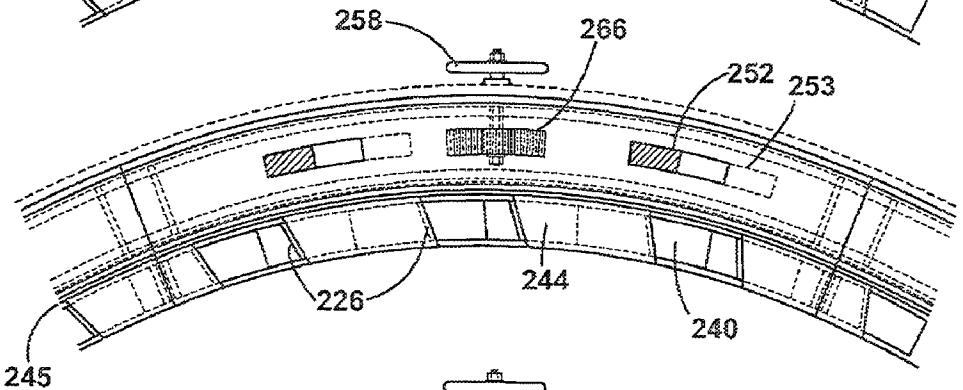
Figure 8C:
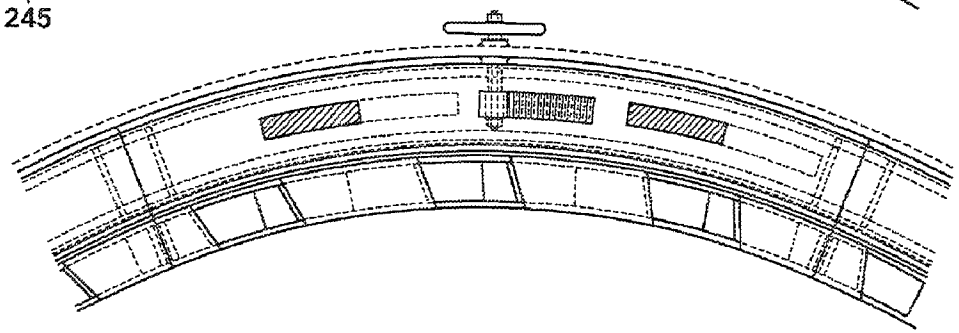

A movable blanking part 252 beneath the mill liner has openings 253 which may be moved into register with the respective openings 250 in order to completely close them (see FIG. 8C); or may be moved totally out of register with the respective openings in order to fully open them (see FIG. 8A); or may be moved to any position in between (see FIG. 8B). Blanking part 252 is a sector of a ring extending around the mill, close to the side wall, beneath the mill liner 234. It has a shape which closely conforms to the shape of the mill liner 234. It has vertical side walls 254 which are supported by bearers 256.

In the embodiment of FIGS. 7 and 8A-8C the arrangement of variable openings 250 in the mill liner is even all the way around the mill liner.

In this embodiment the movement to control the variable openings 250 occurs under mechanical control. A single control wheel 258 is mounted to the outside wall 260 of the mill. The wheel 258 is coupled to a shaft 262 which passes through the wall 260, and carries a pinion gear 264. The pinion gear is in mesh with a rack 266 shown schematically in FIGS. 8A-8C. The rack is mounted to a blanking part which has wheels (not shown) and which is mounted on a support track (not shown) such that turning the wheel 258 advances or draws back an annular band to bring each opening 250 to the same condition. By means of the simple common control it is assured that the air mass flow conditions around the mill are the same. It would be undesirable in this embodiment if certain openings were shut when others were open.

In this second embodiment the summation of the area of the variable openings 250 when fully open is approximately 50% of the summation of the area of the fixed openings 240 in the port ring 224 and of the running clearance 245 between the port ring 224 and the mill liner 234.

Provision of the variable openings 250 means that air speed may be kept at an optimum level across a wide range of airflow rates, and mass transfer rates.

In this second embodiment nested, generally U-section, parts the mill liner 234 and the blanking part 252 are provided. The mill liner is fixed and the blanking part is movable, to open/close the variable apertures 250. The blanking part 252 is advanced or retarded by a spur wheel and rack arrangement. In alternative embodiments these could be any of a number of arrangements, for example other mechanical arrangements e.g. worm and wheel; pneumatic apparatus; hydraulic apparatus; and electrical apparatus; in each case preferably controlled from outside the mill.

What is claimed is:

1. A pulveriser mill having a rotatable grinding ring, and a rotatable port ring around the circumference of the grinding ring that is co-rotatable with the grinding ring, wherein the port ring defines, around its 360 degree extent, a plurality of openings which are separated by lands, the openings permitting air to flow from beneath the grinding ring to above the grinding ring and the lands serving as obstructions to the flow of air from beneath the grinding ring to above the grinding ring, wherein the aspect ratio of the openings is in the range from 1:1 to 3:1, and wherein the lands in total occupy at least 180 degrees of the 360 degree extent of the port ring.

2. The mill as claimed in claim 1, wherein the lands in total occupy up to 280 degrees of the 360 degree extent of the port ring.

3. The mill as claimed in claim 1, wherein there is a running clearance around the port ring providing a further route by which air can flow from beneath the grinding ring to above the grinding ring.

4. The mill as claimed in claim 3, wherein the total area available for air flow from beneath the grinding ring to above the grinding ring is the summation of the openings in the port ring and the running clearance.

5. The mill as claimed in claim 1, wherein there are additional openings adjacent to the periphery of the grinding ring, the additional openings being variable and thereby being able to permit air to flow from beneath the grinding ring to above the grinding ring to a variable extent.

6. The mill as claimed in claim 5, wherein the total area available for air flow from beneath the grinding ring to above the grinding ring is the summation of the openings in the port ring, the running clearance and the additional, variable, openings.

7. A pulveriser mill having a rotatable grinding ring, and a rotatable port ring around the circumference of the grinding ring that is co-rotatable with the grinding ring, wherein the port ring defines, around its 360 degree extent, a plurality of openings which are separated by lands, the openings permitting air to flow from beneath the grinding ring to above the grinding ring and the lands serving as obstructions to the flow of air from beneath the grinding ring to above the grinding ring, wherein the lands occupy from at least 180 degrees to no more than 280 degrees of the 360 degree extent of the port ring.

8. A method of improving an existing pulveriser mill which has a rotatable port ring located around the circumference of a rotatable grinding ring of the mill that is co-rotatable with the grinding ring, the port ring having a plurality of spaced-apart vanes having upper and lower ends, defining openings separated by the through-thickness of the vanes, and the mill having a mill liner mounted to the wall of the mill around the port ring, wherein the method comprises:

replacing the port ring with a second port ring having wider openings that are separated by lands, wherein the lands of the second port ring in total occupy at least 180 degrees of a 360 degree extent of the second port; and one of narrowing the mill liner, replacing the mill liner with a narrower mill liner, and removing the mill liner without replacement.

9. The method as claimed in claim 8, wherein the mill has a rotatable grinding ring, and the rotatable second port ring around the circumference of the grinding ring that is co-rotatable with the grinding ring, wherein the second port ring defines, around its 360 degree extent, the plurality of openings which are separated by lands, the openings permitting air to flow from beneath the grinding ring to above the grinding ring and the lands serving as obstructions to the flow of air from beneath the grinding ring to above the grinding ring, wherein the aspect ratio of the openings is in the range from 1:1 to 3:1.

10. The method as claimed in claim 9, wherein the lands in total occupy up to 280 degrees of the 360 degree extent of the port ring.

11. The method as claimed in claim 9, wherein there is a running clearance around the port ring providing a further route by which air can flow from beneath the grinding ring to above the grinding ring.

12. The method as claimed in claim 11, wherein the total area available for air flow from beneath the grinding ring to above the grinding ring is the summation of the openings in the port ring and the running clearance.

13. The method as claimed in claim 9, wherein there are provided additional openings adjacent to the periphery of the grinding ring, the additional openings being variable and thereby being able to permit air to flow from beneath the grinding ring to above the grinding ring to a variable extent.

14. The method as claimed in claim 13, wherein the total area available for air flow from beneath the grinding ring to above the grinding ring is the summation of the openings in the port ring, the running clearance and the additional, variable, openings.

15. The method as claimed in claim 8, wherein the ratio of the summated area of the openings of the second port ring to the summated area of the openings of the port ring being replaced is in the range 0.7 to 1.3.

16. The method as claimed in claim 8, wherein the ratio of the mean width of the openings in the second port ring to the mean width of the openings of the port ring being replaced is in the range 1.5:1 to 2.5:1.

* * * * *